US007112110B1

(12) United States Patent
Kollmann

(10) Patent No.: US 7,112,110 B1
(45) Date of Patent: Sep. 26, 2006

(54) FUEL SYSTEM CONTAINER FOR A MARINE VESSEL

(75) Inventor: Troy J. Kollmann, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 86 days.

(21) Appl. No.: 10/932,186

(22) Filed: Sep. 1, 2004

(51) Int. Cl.
*B63H 21/38* (2006.01)

(52) U.S. Cl. ..... 440/88 F

(58) Field of Classification Search ..... 440/88 R, 440/88 F

See application file for complete search history.

(56) References Cited

U.S. PATENT DOCUMENTS 4,388,896 A 6/1983 Sheridan et al. ..... 123/73 AD
4,594,970 A * 6/1986 Baars et al. ..... 123/73 AD
4,653,552 A * 3/1987 Friedle ..... 141/98
4,846,118 A 7/1989 Slattery et al. ..... 123/73 AD
4,848,283 A * 7/1989 Garms et al. ..... 123/73 AD
5,195,494 A * 3/1993 Tuckey ..... 123/514
5,832,903 A * 11/1998 White et al. ..... 123/514
5,902,158 A * 5/1999 Nakase et al. ..... 440/88 R
6,250,287 B1 6/2001 Wickman et al. ..... 123/497
6,253,742 B1 7/2001 Wickman et al. ..... 123/516
6,343,966 B1 * 2/2002 Martin et al. ..... 440/88 A
6,390,871 B1 * 5/2002 Wickman et al. ..... 440/88 R
6,527,603 B1 3/2003 Wickman et al. ..... 440/88
6,553,974 B1 4/2003 Wickman et al. ..... 123/516
6,694,955 B1 2/2004 Griffiths et al. ..... 123/516
6,718,953 B1 4/2004 Torgerud ..... 123/516

* cited by examiner

*Primary Examiner*—Sherman Basinger
(74) *Attorney, Agent, or Firm*—William D. Lanyi

(57) ABSTRACT

A fuel system for a marine propulsion system provides a container, in addition to the fuel tank of the marine vessel, which contains fuel pumps, a filter, a pressure regulator, and possibly a fuel cooler. Some or all of these components can be submerged under the surface of a pool of liquid fuel within the container. The container is displaced physically from the fuel tank of a marine vessel.

4 Claims, 2 Drawing Sheets

FUEL SYSTEM CONTAINER FOR A MARINE VESSEL

BACKGROUND OF THE INVENTION

1. Field of the Invention

The present invention relates generally to a fuel system for a marine vessel and, more particularly, to a fuel system that is disposed within a container which is removably attached to a hull of the marine vessel and disposed between a fuel tank and an engine of the marine vessel.

2. Description of the Prior Art

Many different types of fuel systems are known to those skilled in the art of marine vessels and marine propulsion systems. In a typical application of a marine propulsion system, the fuel system uses a low pressure pump, or lift pump, to draw fuel from a fuel tank and provide that fuel to a high pressure pump which pressurizes the fuel and directs it to the marine engine. In some applications, the low and high pressure pumps can be located within a fuel reservoir that serves as a fuel vapor separator. The fuel vapor separator is typically mounted to the engine. In some applications, relating to outboard motors, the fuel vapor separator is attached to a drive shaft housing of the outboard motor. Various types of fuel reservoirs, fuel pumps, and fuel vapor separators have been developed by those skilled in the art and used in various combinations to provide a fuel system for a marine vessel.

U.S. Pat. No. 4,388,896, which issued to Sheridan et al. on Jun. 21, 1983, discloses a lubricating system for a two-cycle engine. The invention provides a remote oil tank to supply oil to an oil reservoir mounted on a two-cycle, crankcase compression engine such as used for outboard motors. Crankcase pressure may be used to pressurize the remote tank to move the oil.

U.S. Pat. No. 4,846,118, which issued to Slattery et al. on Jul. 11, 1989, discloses a dual fuel pump and oil fuel mixing valve system. A marine propulsion system with an outboard engine has an oil-fuel mixing valve within the engine cowl. A first crankcase pressure driven fuel pump delivers fuel from a remote fuel tank to the mixing valve and a second crankcase pressure driven fuel pump delivers mixed oil-fuel from the mixing valve to the engine. The arrangement provides adequate fuel pressure to overcome the added pressure drop across a reduced size mixing valve, all fitting within the engine cowl.

U.S. Pat. No. 4,848,283, which issued to Garms et al. on Jul. 18, 1989, discloses a marine engine with combination vapor return, crankcase pressure, and cooled fuel line conduit. A marine propulsion system includes a two-cycle water cooled crankcase compression internal combustion engine including a vapor separator, a remote fuel tank, and a fuel pump in the tank for delivering fuel to the engine in response to crankcase pulse pressure. A combination conduit between the fuel tank and the engine includes a first passage communicating crankcase pulse pressure from the engine to the fuel pump in the tank, a second passage supplying fuel from the pump in the tank to the engine, a third passage returning fuel vapor from the vapor separator at the engine back to the tank, a fourth passage supplying cooling water from the engine towards the tank, and a fifth passage returning water from the fourth passage back to the engine.

U.S. Pat. No. 5,832,903, which issued to White et al. on Nov. 10, 1998, discloses a fuel supply system for an internal combustion engine. The system has an electronically controlled fuel injection system and eliminates the need for a vapor separator. The system pumps an excessive amount of fuel through a plumbed fuel supply loop and cools recirculated fuel to cool all the components in the plumbed fuel supply loop.

U.S. Pat. No. 6,250,287, which issued to Wickman et al. on Jun. 26, 2001, discloses a fuel delivery system for a marine engine. A fuel pump is housed within the structure of a portable fuel tank. The inlet of a pump is located at the lower portion of the tank and an outlet of the pump is connectable in fluid communication with a flexible conduit. An opposite end of the flexible conduit is connectable in fluid communication with a fuel system of an outboard motor. A water sensor and a fuel level sensor can be provided in conjunction with the pump and attached to the pump in certain embodiments.

U.S. Pat. No. 6,253,742, which issued to Wickman et al. on Jul. 3, 2001, discloses a fuel supply method for a marine propulsion engine. The method uses a lift pump to transfer fuel from a remote tank to a vapor separator tank. Only one level sensor is provided in the vapor separator tank and an engine control unit monitors the total fuel usage subsequent to the most recent filling of the tank.

U.S. Pat. No. 6,553,974, which issued to Wickman et al. on Apr. 29, 2003, discloses an engine fuel system with a fuel vapor separator and a fuel vapor vent canister. The fuel supply system provides an additional fuel chamber, associated with a fuel vapor separator, that receives fuel vapor from a vent of the fuel vapor separator. In order to prevent the flow of liquid fuel into and out of the additional fuel chamber, a valve is provided which is able to block the vent of the additional chamber.

U.S. Pat. No. 6,527,603, which issued to Wickman et al. on Mar. 4, 2003, discloses a fuel supply system for a marine propulsion device. The system includes a reservoir that defines a cavity in which first and second fuel pumps are used. The first fuel pump is a lift pump which draws fuel from a fuel tank and pumps the fuel into the cavity of the reservoir. The second fuel pump is a high pressure pump which draws fuel from the cavity and pumps the fuel at a higher pressure to a fuel rail of an engine.

U.S. Pat. No. 6,694,955, which issued to Griffiths et al. on Feb. 24, 2004, discloses a marine engine with primary and secondary fuel reservoirs. The fuel supply system comprises first and second fuel reservoirs connected in fluid communication with each other. The first fuel reservoir is a fuel vapor separator which has a vent conduit connected in fluid communication with a second fuel reservoir. Under normal operation, fuel vapor flows from the fuel vapor separator into the second fuel reservoir for eventual discharge to the atmosphere.

U.S. Pat. No. 6,718,953, which issued to Torgerud on Apr. 13, 2004, discloses a fuel vapor separator with a flow directing component within a fuel recirculating flow path. The fuel system provides first, second, and third reservoirs of a fuel vapor separator and first, second, and third pumps to cause fuel to be drawn from the fuel tank and provided to the combustion chambers of an internal combustion engine. A flow directing component is provided to inhibit recirculated fuel from mixing directly with fuel within the fuel vapor separator that has not yet been pumped to a fuel rail. The flow directing component receives recirculated fuel and also receives fuel from a second reservoir through an orifice formed through a surface of the flow directing component.

U.S. Pat. No. 6,899,580 discloses a marine fuel system with a Peltier-effect device. The marine propulsion device is provided with a thermal electric device connected in thermal communication with fuel as it flows through the fuel system of an engine. The thermal electric device can be a Peltier-effect device that uses electric current to cause heat to flow from a cold portion of the Peltier-effect device to a hot portion of the Peltier-effect device. A secondary heat exchanger removes heat from the Peltier-effect device. As a result, heat is removed from the fuel in order to inhibit the creation of a vapor lock condition in association with the engine.

The patents described above are hereby expressly incorporated by reference in the description of the present invention.

SUMMARY OF THE INVENTION

A fuel system for a marine propulsion system, made in accordance with a preferred embodiment of the present invention, comprises a container which is shaped to be located between a fuel tank of a marine vessel and an engine of the marine propulsion system. It also comprises a first fuel pump disposed within the container. The first fuel pump has an outlet port which is connectable in fluid communication with the engine of the marine propulsion system. The present invention can further comprise a second fuel pump disposed within the container, wherein the second fuel pump has an inlet port which is connectable in fluid communication with the fuel tank of the marine vessel. The first fuel pump can be connected in signal communication with a microprocessor which provides a first pulse width modulated (PWM) signal that determines the operating speed of the first fuel pump. Similarly, the second fuel pump can be connected in signal communication with the microprocessor which provides a second pulse width modulated (PWM) signal that determines the operating speed of the second fuel pump.

The first fuel pump, which can be a high pressure pump, is connected in fluid communication with a fuel rail of the engine in a preferred embodiment of the present invention. The second fuel pump, which can be a low pressure lift pump, is connected in fluid communication with a fuel tank to draw fuel from the fuel tank and provide the fuel to the first fuel pump in a preferred embodiment of the present invention.

The system can further comprise a pressure regulator disposed within the container and connected in fluid communication between the first fuel pump and the engine. A fuel filter can be disposed within the container and connected in fluid communication with a second fuel pump. The fuel filter, in a preferred embodiment of the present invention, can be connected in fluid communication with a second fuel pump upstream of the second fuel pump. A fuel cooler can be disposed within the container and connected in fluid communication with the first fuel pump. The fuel tank, in a preferred embodiment of the present invention, is disposed within a hull of the marine vessel and the container is disposed physically between the fuel tank and the engine. The container can be removably attachable to the hull.

BRIEF DESCRIPTION OF THE DRAWINGS

The present invention will be more fully and clearly understood from a reading of the description of the preferred embodiment in conjunction with the drawings, in which.

DESCRIPTION OF THE PREFERRED EMBODIMENT

Figure 1:
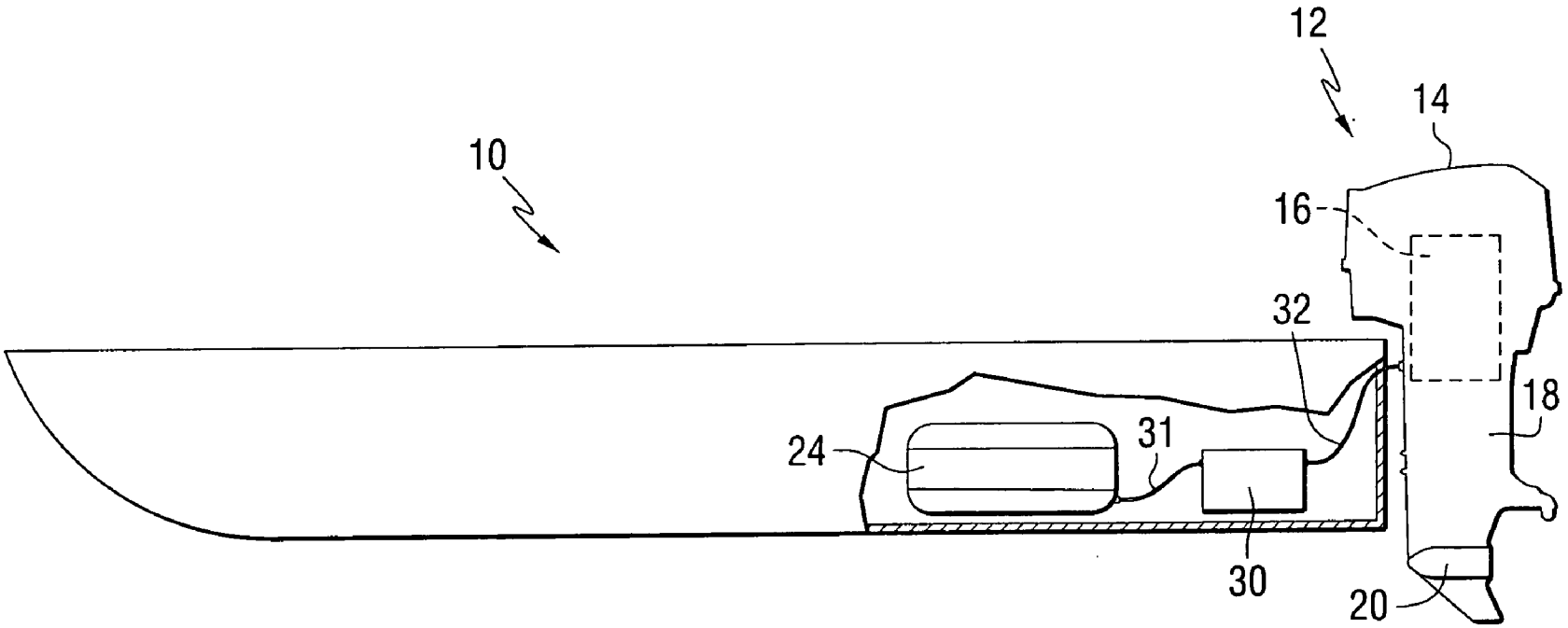
FIG. 1 is a simplified representation of a marine vessel with a fuel tank, the present invention, and a marine propulsion system.

Throughout the description of the preferred embodiment of the present invention, like components will be identified by like reference numerals.

FIG. 1 is a simplified representation of a marine vessel 10 with a marine propulsion system, such as an outboard motor 12. The outboard motor comprises a cowl 14 under which an engine 16 is located. Below the engine 16, a driveshaft housing 18 supports a gear case 20. Although not shown in FIG. 1, a propeller is typically attached to a propeller shaft that is supported by the gear case 20 for rotation about a horizontal axis.

A fuel tank 24 is located within the hull of the marine vessel 10. A container 30 is located between the fuel tank 24 and the engine 16 of the marine propulsion system 12. A first conduit 31 is connected between the fuel tank 24 and the container 30 and a second conduit 32 is connected between the container 30 and the marine engine 16. As will be described in greater detail below, fuel is drawn from the fuel tank 24, flows through the first conduit 31, and is provided to a high pressure pump located within the container 30. The high pressure pump draws the fuel and directs it through the second conduit 32 to a fuel rail of the engine 16.

Figure 2:
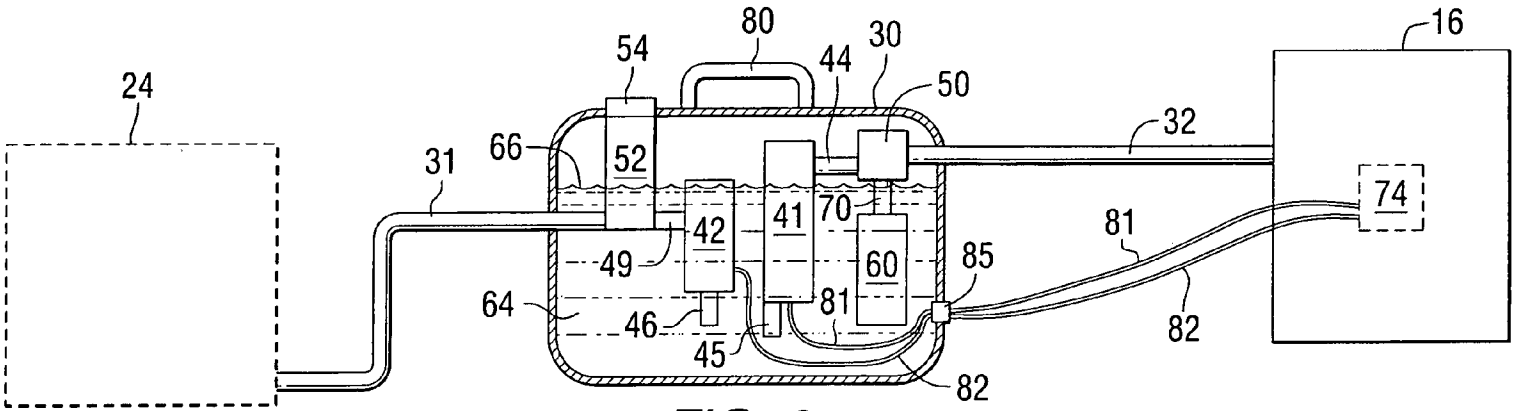
FIG. 2 illustrates a preferred embodiment of the present invention shown in conjunction with a fuel tank and an engine.

FIG. 2 shows the container 30 with a plurality of components disposed therein. A first fuel pump 41 is disposed within the container 30 and provided with an outlet port 44 which is connectable in fluid communication with the engine 16 of the marine propulsion system. A second fuel pump 42 is also disposed within the container 30 in a preferred embodiment of the present invention and is provided with an outlet 46 and an inlet 49 which is connectable in fluid communication with the fuel tank 24. Although not specifically shown in FIG. 2, it should be understood that a typical application of the present invention would connect the first fuel pump 41 in fluid communication with a fuel rail of the engine 16 and the second fuel pump 42, or lift pump, would be configured to draw fuel from the fuel tank 24 and provide the fuel to the first fuel pump 41.

With continued reference to FIG. 2, a pressure regulator 50 is disposed within the container 30 and connected in fluid communication between the first fuel pump 41 and the engine 16. A fuel filter 52 is disposed within the container 30 in a preferred embodiment of the present invention and connected in fluid communication with the second fuel pump 42. In the embodiment shown in FIG. 2, the fuel filter is connected to the second fuel pump 42 at a location upstream from the second fuel pump 42. A removable cap 54 of the fuel filter 52 can be provided and the fuel filter 52 can be configured so that the filter medium of the fuel filter 52 can be removed, through an opening that extends through a wall of the container 30, by removing the cap 54. It should be understood, however, that this embodiment of the fuel filter 52, with a removable cap 54, that extends through an opening in the wall of the container 30 is not a requirement in all embodiments of the present invention. Furthermore, it should be understood that the fuel filter 52 need not be disposed upstream from the second fuel pump 42 in all embodiments.

With continued reference to FIG. 2, a fuel cooler 60 is also disposed within the container 30. Excess fuel flowing from the pressure regulator 50 can be directed to the fuel cooler 60 before being returned to the pool of liquid fuel 64 within the container 30. Reference numeral 66 indicates the level of the pool of liquid fuel. Excess fuel flowing from the pressure regulator 50 to the fuel cooler 60 flows through conduit 70.

In the embodiment of the present invention shown in FIG. 2, the outlet port 46 of the second fuel pump 42 does not connect it directly to the inlet port 44 of the first fuel pump 41. Instead, the second fuel pump 42 provides fuel through its outlet port 46 into the pool 64 within the container 30 and the first fuel pump 41 draws liquid fuel from that pool 64 into its inlet port 45.

With continued reference to FIG. 2, the engine 16 is shown with an engine control module 74 which comprises a microprocessor. Electrical connections are shown between various components within the container 30 and the engine control module 74. For example, a first connection 81 connects the first fuel pump 41 in signal communication with the engine control module 74 and a second connection 82 connects the second fuel pump 42 in signal communication with the engine control module 74. A sealed connector 85 is provided to allow these wires to extend through a wall of the container 30. Although two electrical connections are shown in FIG. 2, it should be understood that this is not limiting to the present invention and these connections are provided as an illustration of the way in which an engine control module 74 and its microprocessor can be used to control the operation of the components within the container 30.

As an example, the first fuel pump 41 can be controlled by a pulse width modulated (PWM) signal provided by the engine control module 74 which controls the operating speed of the high pressure pump 41. Similarly, the lift pump, or second fuel pump 42, can be controlled by a PWM signal provided by the engine control module 74. In addition, one or more liquid level sensors (not shown in FIG. 2) can be used to determine the position of the liquid level 66. These sensors would allow the engine control module 74 to activate or deactivate the second fuel pump 42 as it draws liquid fuel from the fuel tank 24. In this way, the liquid level 66 can be maintained between lower and upper control limits. This also allows the liquid level 66 to be controlled so that selected components within the container 30 can be maintained at least partially submerged under the level 66 and within the pool 64 of liquid fuel.

With reference to FIGS. 1 and 2, it can be seen that the container 30 is physically displaced from both the fuel tank 24 and the engine 16 of the marine propulsion system 12. In certain applications of the present invention, the container 30 can be physically located between the fuel tank 24 and the engine 16, but it should be clearly understood that this particular physical alignment is not required in all embodiments of the present invention.

In operation, the second fuel pump 42, or lift pump, draws fuel from the fuel tank 24 through the first conduit 31. This causes the fuel to flow from the fuel tank 24 into the container 30. The fuel filter 52 is shown in FIG. 2 as being connected upstream from the second fuel pump 42. It should be understood that the fuel filter 52 can alternatively be located downstream from the second fuel pump 42. The embodiment of the present invention shown in FIG. 2 provides a second fuel pump 42 which has an outlet port 46 which is in direct fluid communication with the space within the container 30. This directs fuel into the pool 64 within the container 30. From that pool, the first fuel pump 41 can draw fuel into its inlet port 45 to be pumped toward the engine 16. The pressure regulator 50 is connected to the outlet port 44 of the first fuel pump 41, or high pressure pump, and maintains a desired pressure in the second fluid conduit 32. Fuel that is redirected by the pressure regulator 50 back to the pool 64 within the container 30 can be directed through a fuel cooler 60. The fuel cooler can be of various types. One particular type of fuel cooler can be a thermal electric device, such as a Peltier-effect device, described above.

Figure 3:
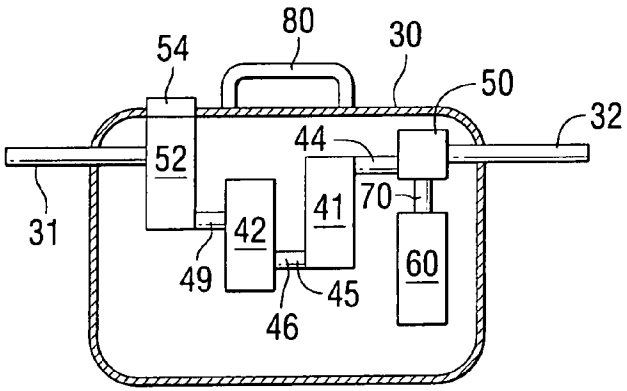

FIG. 3 shows an embodiment of the present invention in which the outlet 46 of the second fuel pump 42 is connected directly to the inlet 45 of the first fuel pump 41. It should be understood that the provision of a pool of liquid fuel, such as pool 64 described above in conjunction with FIG. 2, is not required in all embodiments of the present invention. Also, it is not required that the second fuel pump 42 provide its output of liquid fuel into a pool of fuel prior to that fuel being drawn into the first fuel pump 41.

Figure 4:
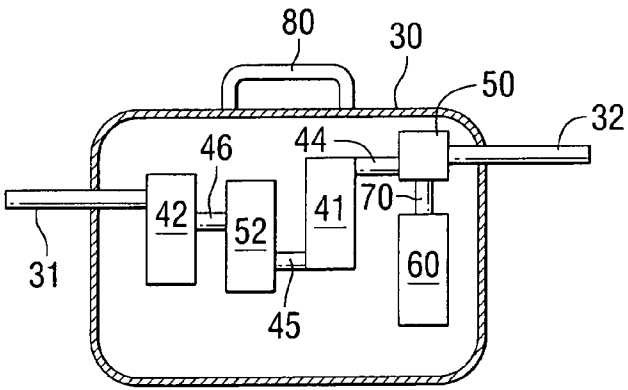
FIGS. 3 and 4 show alternative configurations of the present invention.

FIG. 4 shows an embodiment of the present invention in which the fuel filter 52 is located downstream from the second fuel pump 42. It should be understood that the fuel filter 52 can be located at various positions along the flow path of fuel. Certain advantages are obtained by locating the fuel filter upstream from the second fuel pump 42. One of those advantages is that the fuel filter 52 would be maintained at a low pressure and this could allow the filter medium of the fuel filter 52 to be changed more easily and, possibly, through a removable cap 54 that allows the filter medium to be replaced through an opening in the container 30.

With reference to FIGS. 1–4, a preferred embodiment of the present invention provides a container 30 that is shaped to be located between a fuel tank 24 of a marine vessel and an engine 16 of the marine propulsion system. A first fuel pump 41 is disposed within the container 30 and has an outlet port 44 which is connectable in fluid communication with the engine 16. The second fuel pump 42 can also be disposed within the container 30 and has an inlet port 49 which is connectable in fluid communication with the fuel tank 24. A microprocessor 74 can be connected in signal communication with the first and second fuel pumps and with the pressure regulator 50. In one particular embodiment of the present invention, the first and second fuel pumps, 41 and 42, the pressure regulator 50, the fuel filter 52, and the fuel cooler 60 are all located within the container 30. However, it should be understood that some of these components illustrated within the container 30 in FIGS. 2–4, could alternatively be located outside of the container 30. The container 30 can be provided with a handle 80 to facilitate its removal and replacement. Although not shown in the figures, it should also be understood that the first and second conduits, 31 and 32, could be provided with quick disconnecting couplings to facilitate this connection and disconnection of the container from the fuel tank 24 and engine 16. In certain embodiments of the present invention, a pool 64 of liquid fuel is maintained within the container 30 and the components located within the container 30 can be submerged at least partially within that pool 64.

Although the present invention has been described in particular detail and illustrated to show several embodiments, it should be understood that alternative embodiments are also within its scope.

I claim:

1. A fuel system for a marine propulsion system, comprising:

a container which is shaped to be located between a fuel tank of a marine vessel and an engine of said marine propulsion system, said container being located forwardly of a transom of said marine vessel;

a first fuel pump disposed within said container, said first fuel pump having an outlet port which is connectable in fluid communication with said engine of said marine propulsion system;

a second fuel pump disposed within said container, said second fuel pump having an inlet port which is connectable in fluid communication with said fuel tank of said marine vessel;

a fuel filter disposed within said container and connected in fluid communication with said second fuel pump;

said fuel filter includes a removable cap permitting removal of filter medium through an opening through a wall of said container.

2. A fuel system for a marine propulsion system, comprising:

a container which is shaped to be located between a fuel tank of a marine vessel and an engine of said marine propulsion system, said container being located forwardly of a transom of said marine vessel;

a first fuel pump disposed within said container, said first fuel pump having an outlet port which is connectable in fluid communication with said engine of said marine propulsion system;

a second fuel pump disposed within said container, said second fuel pump having an inlet port which is connectable in fluid communication with said fuel tank of said marine vessel;

a pressure regulator disposed in said container and connected in fluid communication between said first fuel pump and said engine, wherein fuel flows from upstream to downstream along a fuel flow path from said second fuel pump to said first fuel pump to said engine, and wherein said pressure regulator is located in said container and along said fuel flow path downstream of said first fuel pump and upstream of said engine;

a fuel cooler disposed within said container and connected in fluid communication with said first fuel pump, wherein said pressure regulator has a return within said container and returning fuel to a point between said second and first fuel pumps, namely downstream of said second fuel pump and upstream of said first fuel pump, and wherein said fuel cooler is in said return, and said fuel cooler has an inlet connected to said pressure regulator, and said fuel cooler has an outlet connected to said point between said second and first fuel pumps.

3. A fuel system for a marine propulsion system, comprising:

a container which is shaped to be located between a fuel tank of a marine vessel and an engine of said marine propulsion system, said container being located forwardly of a transom of said marine vessel;

a fuel pump disposed within said container, said fuel pump having an outlet port which is connectable in fluid communication with said engine of said marine propulsion system;

a pressure regulator disposed in said container and connected in fluid communication with said fuel pump and said engine, wherein fuel flows from upstream to downstream along a fuel flow path from said fuel pump to said engine, and wherein said pressure regulator is located in said container along said fuel flow path downstream of said fuel pump and upstream of said engine;

a fuel cooler disposed within said container and connected in fluid communication with said fuel pump, wherein said pressure regulator has a return within said container and returning fuel to an inlet of said fuel pump, and wherein said fuel cooler is in said return, and said fuel cooler has an inlet connected to said pressure regulator, and said fuel cooler has an outlet returning fuel to said inlet of said fuel pump.

4. The fuel system of claim 3, further comprising:

a fuel filter disposed within said container and filtering fuel from said fuel tank, and wherein said return of said pressure regulator returns fuel to said inlet of said fuel pump without passing through said fuel filter.

* * * * *